US010613458B2

(12) United States Patent
Kasuya

(10) Patent No.: US 10,613,458 B2
(45) Date of Patent: Apr. 7, 2020

(54) IMAGE FORMING APPARATUS THAT CONTROLS TEMPERATURE OF FIXING UNIT

(71) Applicant: CANON KABUSHIKI KAISHA, Tokyo (JP)

(72) Inventor: Kenji Kasuya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/509,865

(22) Filed: Jul. 12, 2019

(65) Prior Publication Data

US 2020/0033773 A1 Jan. 30, 2020

(30) Foreign Application Priority Data

Jul. 30, 2018 (JP) ..... 2018-142562

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/2064* (2013.01); *G03G 15/556* (2013.01)

(58) Field of Classification Search
CPC ..... G03G 15/2053; G03G 15/2039; G03G 15/2064; G03G 15/556; G03G 15/2046
See application file for complete search history.

(56) References Cited

U.S. PATENT DOCUMENTS

| | | | | |
|---|---|---|---|---|
| 9,075,356 | B2 | 7/2015 | Ooyanagi | |
| 10,203,638 | B2 | 2/2019 | Shindo | |
| 2014/0072321 | A1 | 3/2014 | Ooyanagi | |
| 2015/0139676 | A1* | 5/2015 | Yamamoto | G03G 15/2039 399/69 |
| 2015/0160593 | A1* | 6/2015 | Masumoto | G03G 15/2039 399/69 |
| 2015/0253702 | A1* | 9/2015 | Morishita | G03G 15/36 399/69 |
| 2017/0315481 | A1 | 11/2017 | Shindo | |

* cited by examiner

*Primary Examiner* — Sandra Brase
(74) *Attorney, Agent, or Firm* — Venable LLP

(57) ABSTRACT

An image forming apparatus includes: a fixing unit configured to fix a toner image to a sheet; a determination unit configured to determine, based on image data, a toner application amount corresponding to each of a plurality of regions in the sheet; and a control unit configured to weight the toner application amount of each of the plurality of regions with a region weight, and to control a temperature of the fixing unit based on the toner application amount of each of the plurality of regions that is weighted. The region weight is determined in accordance with a position of the region in the sheet in a conveyance direction of the sheet, and a region weight at a leading end in the conveyance direction is smaller than a region weight at a rear end in the conveyance direction.

10 Claims, 7 Drawing Sheets

IMAGE FORMING APPARATUS THAT CONTROLS TEMPERATURE OF FIXING UNIT

BACKGROUND OF THE INVENTION

Field of the Invention

The present invention relates to temperature control of a fixing unit of an image forming apparatus.

Description of the Related Art

In an electrophotographic image forming apparatus, heat and pressure are applied by a fixing unit to a sheet on which a toner image is formed to fix the toner image to the sheet. The temperature (fixing temperature) of the fixing unit is determined on the basis of the toner application amount per unit area of the sheet, for example. US-2014-072321 discloses a configuration for controlling the fixing temperature on the basis of the area of the image region where the toner application amount is equal to or greater than a predetermined value. US-2017-315481 discloses a configuration for controlling the fixing temperature in accordance with the presence or absence of an image region where the toner application amount falls within a predetermined range.

Normally, in regions where toner is not applied or regions where the toner application amount is small in the sheet, heat of the fixing unit is lost due to the moisture evaporation in the sheet. In view of this, the fixing temperature is set such that the heat amount required to melt the toner can be obtained even at a rear end portion of the sheet in the conveyance direction. Here, the loss of heat amount due to the moisture evaporation of the recording material is small when the position of the image region that matches a predetermined condition regarding the toner application amount is located near the leading end of the sheet in the conveyance direction. Therefore, when the position of the image region that matches a predetermined condition regarding the toner application amount is located at the leading end of the sheet in the conveyance direction, the heat amount becomes excessive and the power is wastefully consumed when the fixing temperature is controlled at the same temperature as in the case where the position is located at the rear end of the sheet. In the configurations disclosed in US-2014-072321 and US-2017-315481, however, the same fixing temperature is used regardless of the position of the image region that matches a predetermined condition regarding the toner application amount in the sheet.

SUMMARY OF THE INVENTION

An image forming apparatus includes: an image forming unit configured to form a toner image on a sheet based on image data; a fixing unit configured to fix the toner image to the sheet; a determination unit configured to determine, based on the image data, a toner application amount corresponding to each of a plurality of regions in the sheet on which the toner image is to be formed; and a control unit configured to weight the toner application amount of each of the plurality of regions with a region weight imparted to each of the plurality of regions, and to control a temperature of the fixing unit based on the toner application amount of each of the plurality of regions that is weighted. The region weight is determined in accordance with a position of the region in the sheet in a conveyance direction of the sheet, and a region weight at a leading end in the conveyance direction is smaller than a region weight at a rear end in the conveyance direction.

Further features of the present invention will become apparent from the following description of exemplary embodiments with reference to the attached drawings.

DESCRIPTION OF THE EMBODIMENTS

Figure 1:
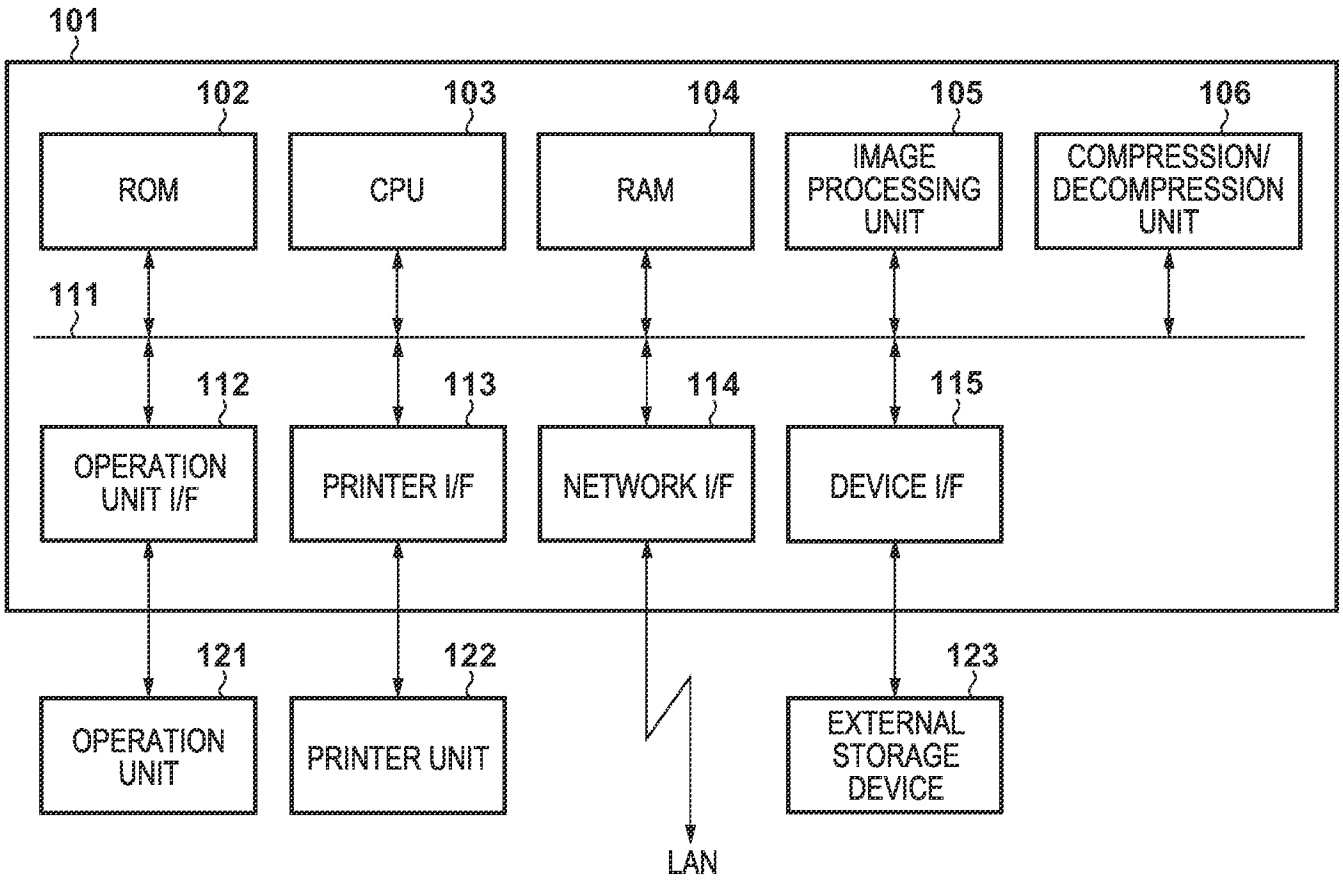
FIG. 1 is a control configuration diagram of an image forming apparatus.

Embodiments of the present invention are described below with reference to the accompanying drawings. Note that the following embodiments are merely examples, and the present invention is not limited to the embodiments. Components that are not necessary for the description of the embodiments are omitted in the drawings.

FIG. 1 is a control configuration diagram of an image forming apparatus according to the present embodiment. The image forming apparatus is, for example, an electrophotographic color image forming apparatus such as a digital copier, a laser printer, and a facsimile. While the image forming apparatus is a color image forming apparatus in the present embodiment, the present invention may be applied to a monochrome image forming apparatus. A central processing unit (CPU) 103 of a controller 101 controls the entire image forming apparatus. A ROM 102 stores a program configured to be executed by the CPU 103. A RAM 104 stores data configured to be used by the CPU 103 for its control, and stores data required to be temporarily stored.

An operation unit interface (I/F) 112 is connected to an operation unit 121. The operation unit 121 is a user interface for a user to control the image forming apparatus, and for displaying the state of the image forming apparatus to the user. A device I/F 115 is connected to an external storage device 123. The external storage device 123 is, for example, a storage medium such as a hard disk drive (HDD), and is used for storing data spools, programs, various information files, image data, and the like. A network I/F 114 is a connection interface with a local area network (LAN). As described later, an image processing unit 105 performs various processes on the image data. A compression/decompression unit 106 compresses and decompresses the image data. A printer I/F 113 is connected to a printer unit 122 described later. Note that the functional blocks of the controller 101 are connected to each other through a system bus 111, and can communicate with each other.

Figure 2:
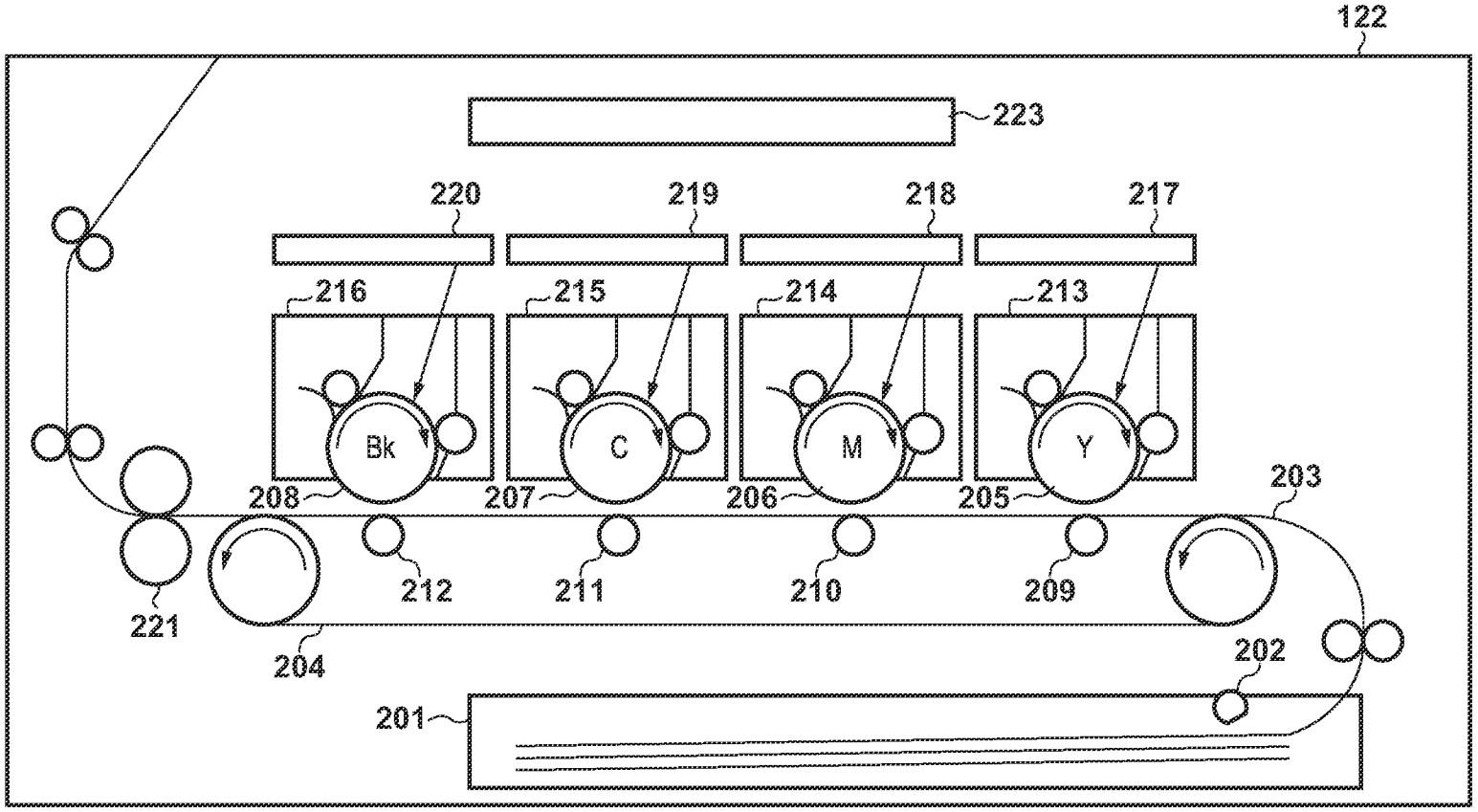
FIG. 2 is a configuration diagram of a printer unit of the image forming apparatus.

FIG. 2 is a configuration diagram of the printer unit 122. Photosensitive members 205 to 208 of cartridges 213 to 216 are driven into rotation in the arrow direction in the drawing during image formation. The photosensitive members 205 to 208 electrically charged by a charging unit (not shown) to a predetermined potential are respectively exposed by corresponding optical units 217 to 220, and thus electrostatic latent images are formed on the photosensitive members 205 to 208. Development units (not shown) of the cartridges 213 to 216 develop the electrostatic latent images of the corresponding photosensitive members 205 to 208 with toner, and form toner images on the photosensitive members 205 to 208. Note that the electrostatic latent images of the photosensitive members 205, 206, 207 and 208 are developed with toners of yellow (Y), magenta (M), cyan (C), and black (Bk), respectively.

A sheet housed in a cassette 201 is fed to the conveyance path by a feeding roller 202, and then conveyed by a transfer belt 204. Note that a drive roller 203 drives the transfer belt 204 into rotation. Transfer rollers 209 to 212 output a transfer bias to transfer the toner images of the corresponding photosensitive members 205 to 208 to the sheet conveyed by the transfer belt 204. The sheet on which the toner images have been transferred is conveyed to a fixing unit 221. The fixing unit 221 fixes the toner image to the sheet by applying heat and pressure to the sheet. After fixing the toner image, the sheet is discharged to the outside of the image forming apparatus. A printer controller 223 is connected to the printer I/F 113 of the controller 101 and controls each member illustrated in FIG. 2 to form an image on a sheet under control of the controller 101.

Figure 3:
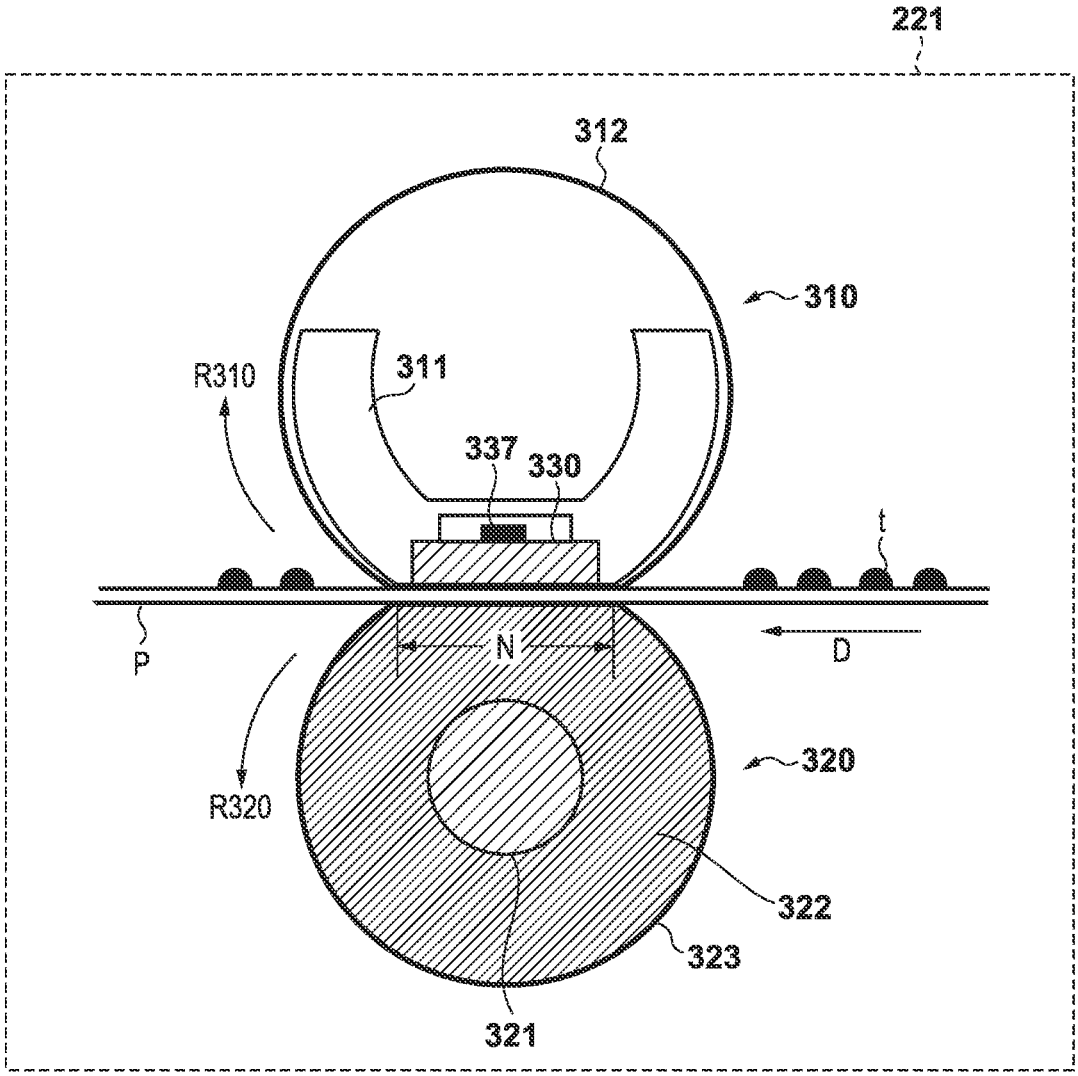
FIG. 3 is a configuration diagram of a fixing unit.

FIG. 3 is a configuration diagram of the fixing unit 221. The fixing unit 221 includes a heating roller 310 and a pressure roller 320. A ceramic heater (hereinafter referred to as heater) 330 is a heat source, and is fixed and supported in a stay 311. A temperature sensor 337 is attached to the heater 330. The stay 311 having heat resistance and an electrical insulation property, may be composed of a rigid material that can withstand heavy weight tolerance. For example, the stay 311 is composed of PPS (polyphenylene sulfide), PAI (polyamide-imide), PI (polyimide), PEEK (polyetheretherketone), and the like. A fixing film 312 is, for example, a heat resistant film having flexibility in its entirety, and has a thickness of approximately 30 μm to 250 μm. The fixing film 312 is loosely fitted to the outside of the stay 311. For example, a single layer film of PTFE, PFA, PPS or the like, or a multiple layer film in which a surface of a base layer of PI, PAI, PEEK or the like is coated with a release layer of PTFE, PFA or the like may be used as the fixing film 312. In addition, the fixing film 312 may be a film including a base layer composed of pure metals, alloys or the like having high thermal conductivity such as SUS, AI, Ni, Cu and Zn, and a release layer obtained by performing the above-mentioned coating treatment and fluorine resin tube coating.

The pressure roller 320 includes a core 321, a roller layer 322 concentric with the core 321, and a surface layer 323. An elastic and heat-resistant material such as silicone rubber is used for the roller layer 322. The heating roller 310 is disposed above the pressure roller 320. The stay 311 is held with a predetermined pressing force against the upper surface of the pressure roller 320 with the fixing film 312 therebetween. As a result, a fixing nip portion N is formed in the conveyance direction D of the sheet. The pressure roller 320 is driven by a driving source (not shown) into rotation in the direction of an arrow R320. The rotational force of the pressure roller 320 is transmitted to the heating roller 310 by the pressure contact friction force at the fixing nip portion N, and thus the heating roller 310 rotates in the direction of an arrow R310.

The CPU 103 causes a current to flow through the heater 330 so as to cause the heater 330 to generate heat, and thus the CPU 103 causes the temperature of the fixing nip portion N to be controlled. A sheet P on which an unfixed toner image t is formed is conveyed in a clamped manner in the state where the side on which the toner image t is formed is in close contact with the fixing film 312. In this process, the heat of the heater 330 is applied to the sheet P through the fixing film 312, and the toner image t is fixed to the sheet P.

Figure 4:
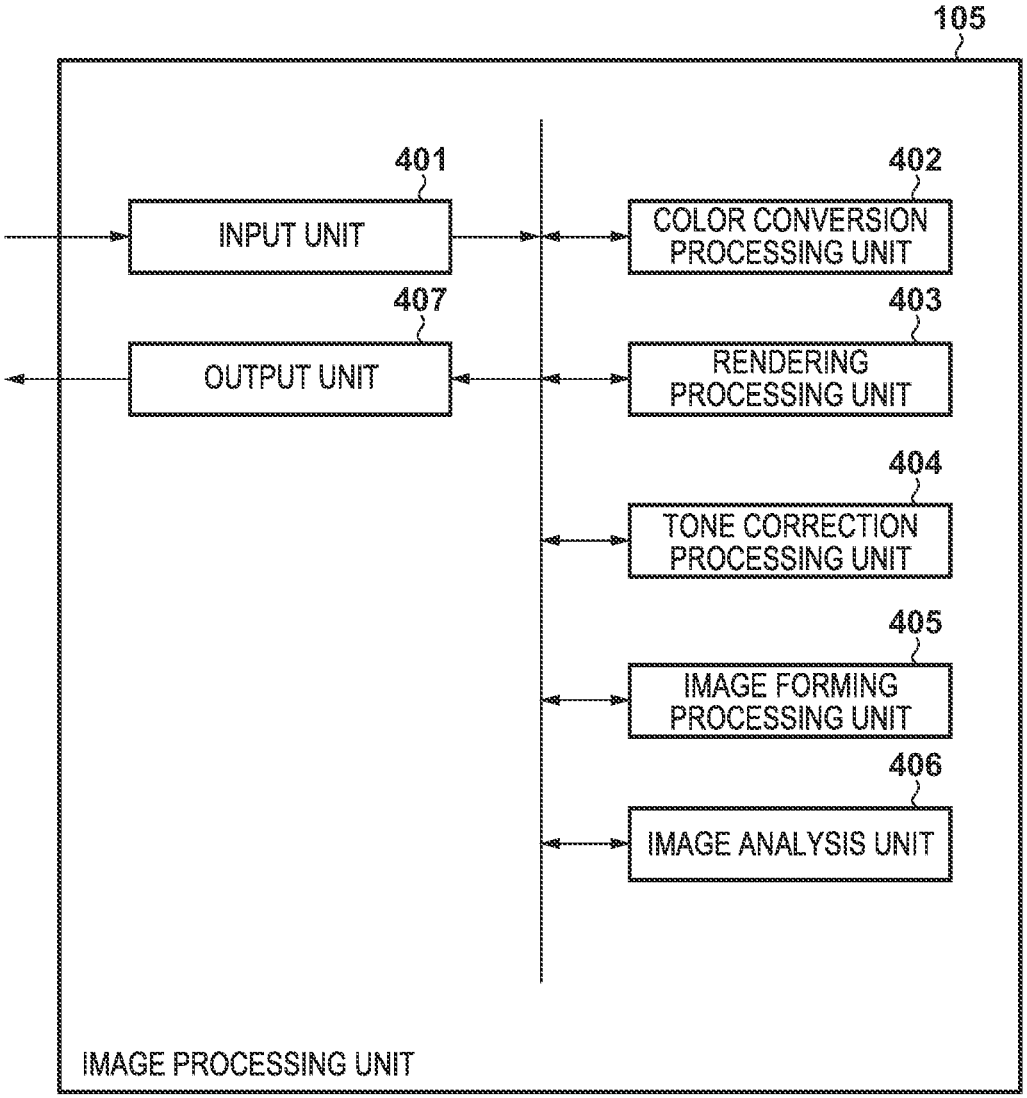
FIG. 4 is a functional block diagram of an image processing unit.

FIG. 4 is a configuration diagram of the image processing unit 105. An input unit 401 receives, from the network I/F 114, PDL data described in a PDL (page-description language), for example. A rendering processing unit 403 converts PDL data into RGB image data. A color conversion processing unit 402 converts the RGB image data into CMYK image data. A tone correction processing unit 404 performs tone correction of the CMYK image data. An image forming processing unit 405 performs required processing including halftone processing on the CMYK image data having been subjected to the tone correction. An image analysis unit 406 analyzes the CMYK image data having been subjected to the image forming process to generate temperature determination information described later, and stores the data in the RAM 104. The image data processed by the image forming processing unit 405 is transferred to the compression/decompression unit 106 via an output unit 407, and is stored in the RAM 104 after being compressed in a prescribed compression method. The CPU 103 causes the compression/decompression unit 106 to decompress the compressed data stored in the RAM 104, and transfers the decompressed data and the temperature determination information stored in the RAM 104 to the printer unit 122 via the printer I/F 113 to execute printing.

Figure 5B:
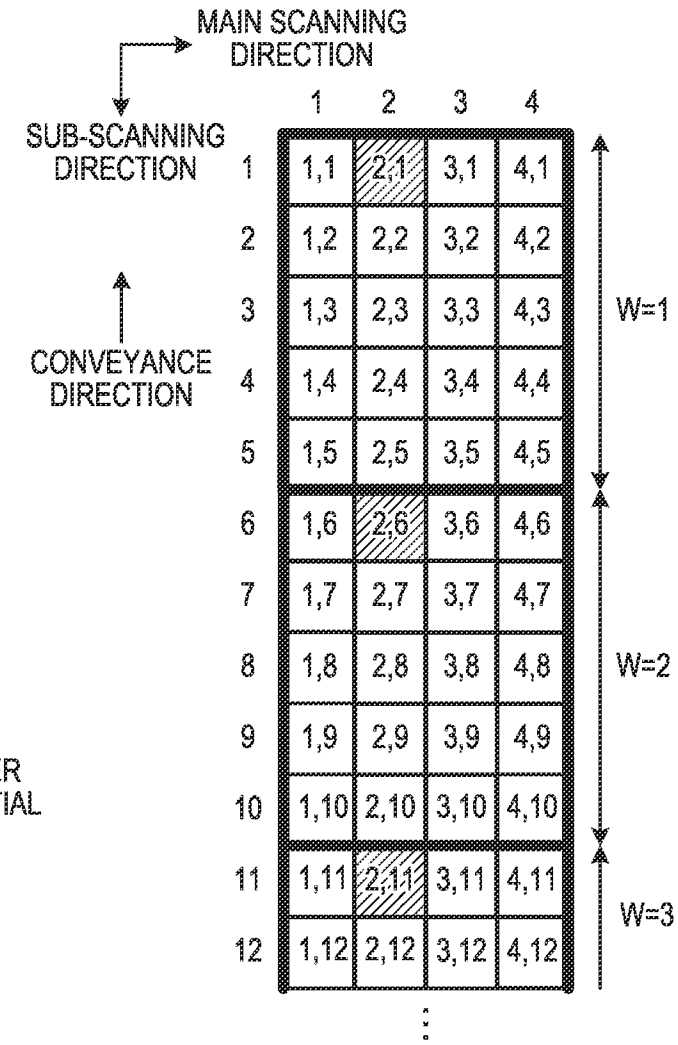
FIGS. 5A and 5B are explanatory diagrams of a process of generating temperature determination information of an image analysis unit.
Figure 5A:
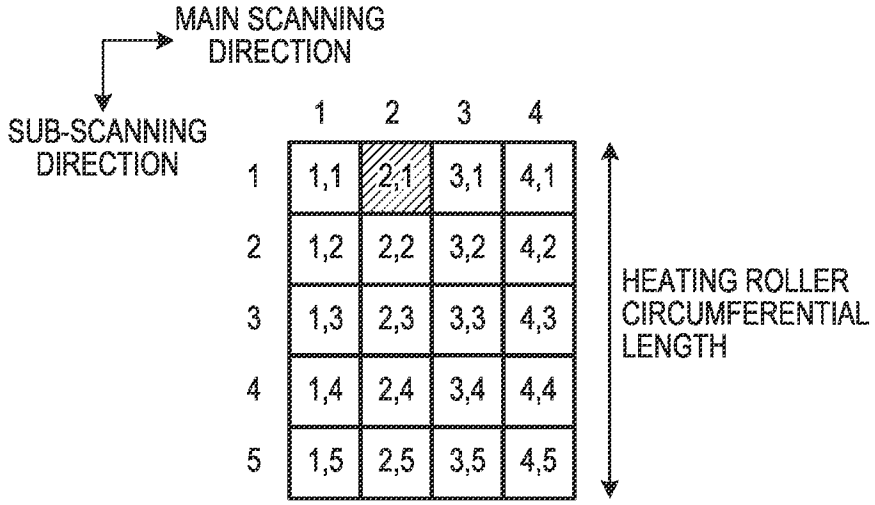

FIGS. 5A and 5B are explanatory diagrams of a process of generating temperature determination information executed by the image analysis unit 406. In the present embodiment, as illustrated in FIG. 5A, a prescribed range of the surface of the heating roller 310 is divided into a plurality of local regions. Here, in a main scanning direction, the prescribed range is the same range as the contact area with the sheet or the image forming region of the sheet, and, in a sub-scanning direction, the prescribed range extends over one circumference of the heating roller 310. Note that the sub-scanning direction corresponds to the conveyance direction of the sheet, and the main scanning direction is a direction orthogonal to the sub-scanning direction. Note that, as illustrated in FIG. 5A, the length of the local region in the sub-scanning direction has a value obtained by dividing the circumferential length of the heating roller 310 by an integer. In the example illustrated in FIG. 5A, the length of the local region in the sub-scanning direction is ⅕ of the circumferential length of the heating roller 310, and accordingly the region is divided into five local regions in the sub-scanning direction. Note that in the example of FIG. 5A, the region is divided into four local regions in the main scanning direction. Note that the length of the local region in the main scanning direction and the length of the local region in the sub-scanning direction may be the same or different. In the following description, the number of local regions in the main scanning direction of the heating roller 310 is represented by Fx, and the number of local regions in the sub-scanning direction of the heating roller 310 is represented by Fy. Also, as illustrated in FIG. 5B, the entire region or the image forming region of the sheet is divided into local regions of the same size as the size applied to the heating roller 310. In the following description, for the purpose of distinguishing the local region of the sheet from that of the heating roller 310, the local region of the sheet is referred to as a first region, and the local region of the heating roller 310 is referred to as a second region.

In addition, in the following description, a first region that is xth from the left end with respect to the conveyance direction of the sheet, and is yth from the leading side in the conveyance direction of the sheet is represented by coordinates (x, y) as illustrated in FIG. 5B. Further, the coordinates of the first region where the sheet makes contact with the heating roller 310 in a first turn are used as the coordinates of the second region. That is, the second region of the coordinates (1, 1) is a region that makes contact with the first region of the coordinates (1, 1) in the first turn of the heating roller 310. Accordingly, the second region of the coordinates (1, 1) makes contact with the first region of the coordinates (1, 6) in the second turn of the heating roller 310, and with the first region of the coordinates (1, 11) in the third turn. In other words, the first region of coordinates (x, y) is heated by making contact with the second region of coordinates (x, p), where $p=(y-1 \bmod Fy)+1$. Note that Fy=5 in the present example.

The image analysis unit 406 imparts, to each first region, a weight W on the basis of the position in the sub-scanning direction in the sheet. In the present embodiment, as illustrated in FIG. 5B, the weight W of the first region that makes contact with the heating roller 310 in the first turn of the heating roller 310 is set to 1, and the weight W of the first region that makes contact with the heating roller 310 in the second turn of the heating roller 310 is set to 2. That is, the weight W of the first region that makes contact with the heating roller 310 in n-th turn of the heating roller 310 is set to n. The image analysis unit 406 analyzes the image data, having been subjected to the halftone processing of the image forming processing unit 405, to calculate a toner application amount T of each first region. Thereafter, the image analysis unit 406 calculates a toner application amount WT after correction (weighting) of each first region by multiplying the toner application amount T of each first region by the corresponding weight W. Thereafter, a target toner amount ST of the second region is calculated. The target toner amount ST of the second region is an integrated value of the corrected toner application amount WT of each first region that makes contact with that second region. For example, the target toner amount ST of the second region of the coordinates (2, 1) is given by the integrated value of the toner application amount WT after correction of the first regions of coordinates (2, 1), (2, 6), (2, 11), . . . . In other words, the image analysis unit 406 groups the first regions. Here, the first regions belonging to the same group make contact with the same second region. Accordingly, the groups correspond to the respective second regions, and the number of the groups is equal to the number of the second regions. The image analysis unit 406 calculates the target toner amount ST by integrating the corrected toner application amounts WT in the group corresponding to the second region.

Next, the image analysis unit 406 calculates an integrated target toner amount SAT by integrating the target toner amount ST of each second region located at the same position in the main scanning direction. That is, in the example in FIG. 5A, the integrated value of the target toner amounts ST of the second regions of coordinates (1, 1), (1, 2), (1, 3), (1, 4), and (1, 5) is the integrated target toner amount SAT of x=1. The image analysis unit 406 stores a maximum value in the integrated target toner amount SAT at each position in the main scanning directions in the RAM 104 as temperature determination information.

Figure 6:
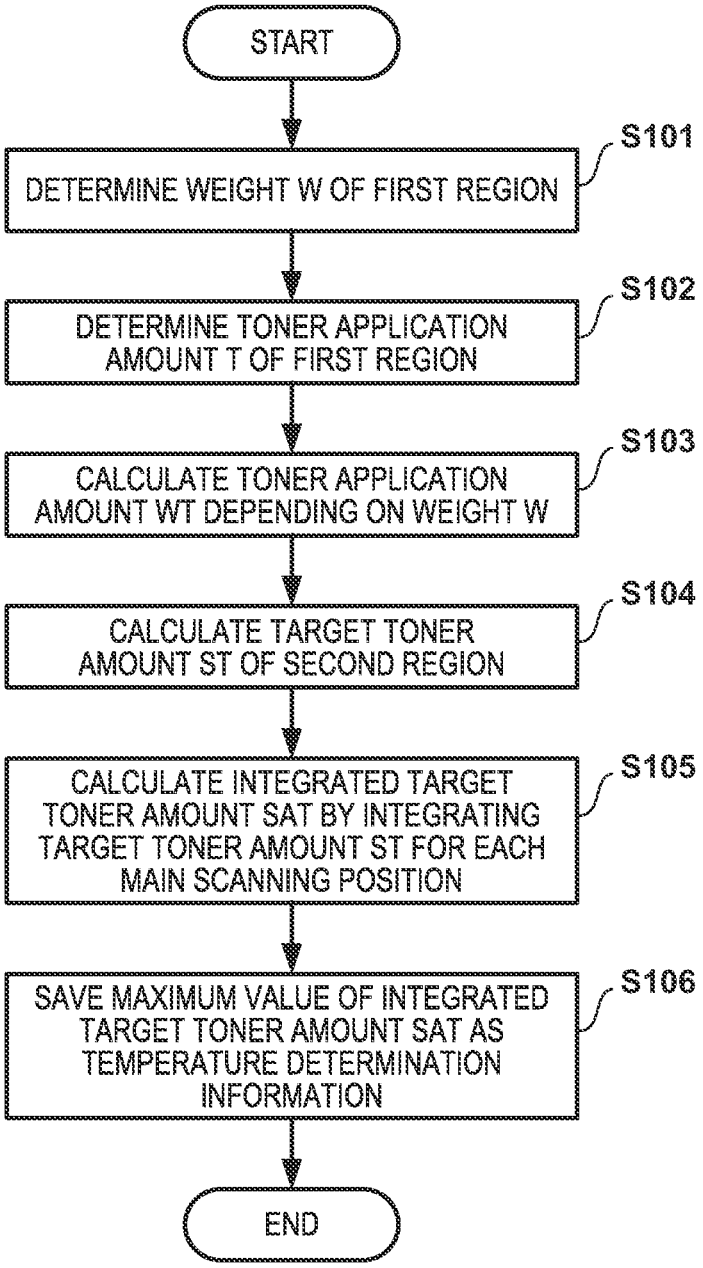
FIG. 6 is a flowchart of a process of generating temperature determination information of the image analysis unit.

FIG. 6 is a flowchart of a process of generating temperature determination information executed by the image analysis unit 406. At S101, the image analysis unit 406 determines the weight W of each first region on the basis of the circumferential length of the heating roller 310 as illustrated in FIG. 5B. At S102, the image analysis unit 406 analyzes the image data having been subjected to the halftone processing of the image forming processing unit 405 to determine the toner application amount T of each first region. The method of determining the toner application amount T is described later. At S103, the image analysis unit 406 calculates the corrected toner application amount WT by multiplying the toner application amount T of each first region by the corresponding weight W. At S104, the image analysis unit 406 calculates, for each second region of the heating roller 310, the target toner amount ST by integrating the corrected toner application amounts WT of the corresponding first regions. At S105, the image analysis unit 406 calculates the integrated target toner amount SAT of each main scanning position by integrating the target toner amounts ST for each main scanning position. At S106, the image analysis unit 406 stores, in the RAM 104, the maximum value of the integrated target toner amount SAT at each main scanning position as temperature determination information.

Figure 7:
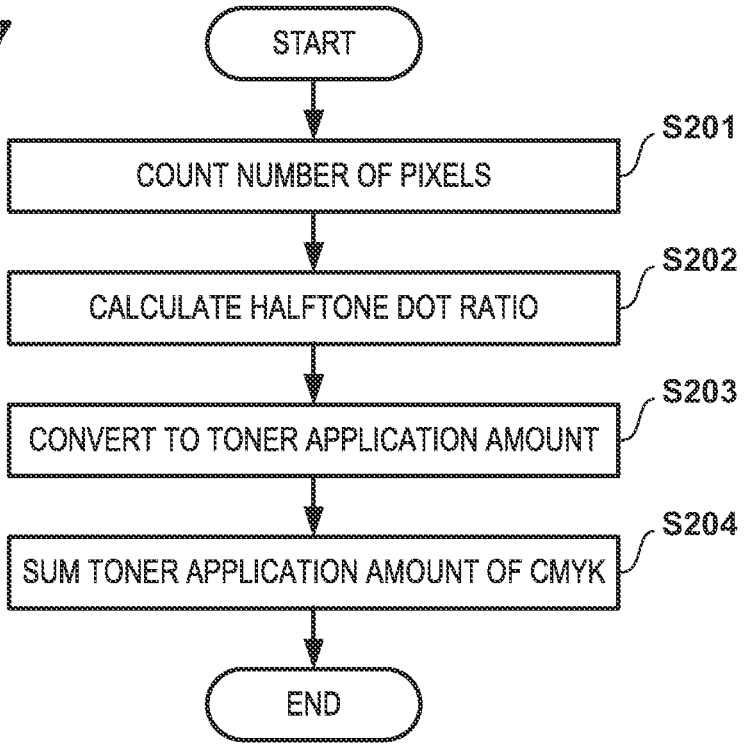
FIG. 7 is a flowchart of a toner application amount determination process of the image analysis unit.

FIG. 7 is a flow chart of a process of determining toner application amount Tat S102 of FIG. 6. As described with reference to FIG. 4, the image analysis unit 406 determines the toner application amount T of each first region on the basis of the image data having been subjected to the halftone processing of the image forming processing unit 405. Here, the image data having been subjected to the halftone processing represents an image by an area gradation. Accordingly, in the present embodiment, the halftone dot ratio per unit area is analyzed, and the toner application amount is obtained from the analysis result by an inverse operation. Note that the process in FIG. 7 is performed for each first region. In addition, S201 to S203 of the process in FIG. 7 is performed for each of the CMYK colors.

At S201, the image analysis unit 406 counts the number of pixels in the first region. At S202, the image analysis unit 406 determines the halftone dot ratio from the number of pixels with respect to the area of the first region. Note that the halftone dot ratio is 100% when the entire first region is colored with a single solid color. The image analysis unit 406 converts the halftone dot ratio to the toner application amount T at S203. Note that the conversion may be performed on the basis of a predetermined table providing the relationship between the halftone dot ratio and the toner application amount T. At S204, the image analysis unit 406 determines the toner application amount T of the first region by calculating the sum of the toner application amounts of CMYK of the first region determined at S203.

Figure 8:
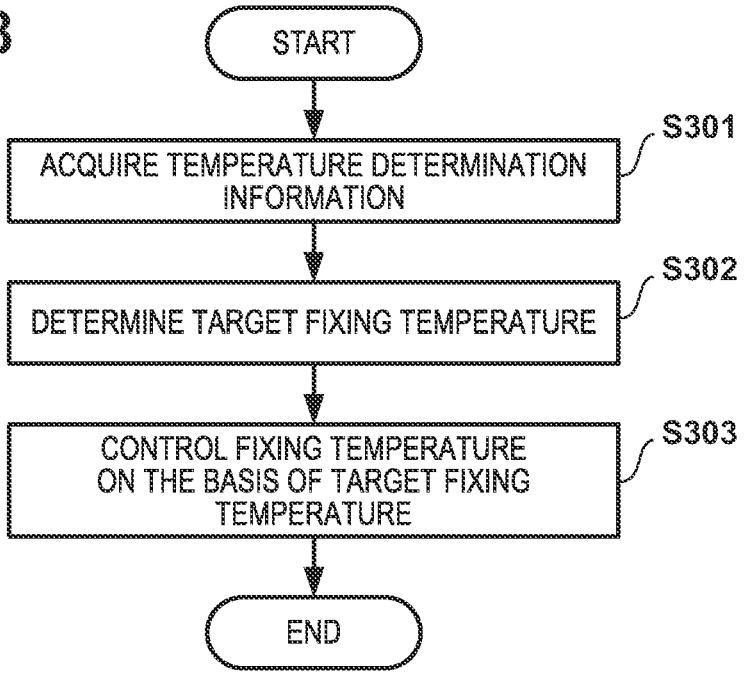
FIG. 8 is a flowchart of a process of controlling a fixing temperature.

FIG. 8 is a flowchart of a fixing temperature control process according to the present embodiment. At S301, the CPU 103 acquires the temperature determination information determined in the process of FIG. 6 for the next image to be formed on a sheet. At S302, the CPU 103 determines a target fixing temperature on the basis of the temperature determination information. The target fixing temperature may be determined on the basis of preliminarily created information representing the relationship between the temperature determination information and the target fixing temperature. For example, the target fixing temperature may be increased as the toner application amount represented by the temperature determination information increases. At S303, the CPU 103 controls the fixing temperature such that the temperature of the fixing unit 221 is set to the target fixing temperature.

While the toner application amount T of each first region is determined on the basis of the image data having subjected to the halftone processing of the image forming processing unit 405 in the present embodiment, the present invention is not limited to this. For example, it is also possible to adopt a configuration in which the toner amount of the first region is determined on the basis of image data prior to the tone correction processing of the tone correction processing unit 404. The reason for this is that, since the image data prior to the tone correction processing indicates the toner application amount, the toner application amount T of each first region can be determined by integrating the pixel values of the pixels in each first region.

As has been described, in the present embodiment, a sheet is divided into a plurality of local regions (first regions), and the toner application amount T of each local region is weighted in accordance with the position in the sub-scanning direction. Note that the weight of the local region is determined on the basis of the position of that local region in the sub-scanning direction and the circumferential length of the heating roller 310, and is increased toward the rear side of the sheet in the conveyance direction. Then, the target toner amount ST in each second region is determined by integrating the toner application amounts T of the weighted first regions to be heated in the same region (second region) of the heating roller 310. The target toner amount ST of the second region corresponds to the toner amount to be fixed by the second region. Then, the integrated target toner amount SAT at each main scanning position is calculated by integrating the target toner amount ST of each second region for each main scanning position. The integrated target toner amount SAT of the main scanning position corresponds to the toner amount to be fixed at the main scanning position. Then, the target fixing temperature is determined on the basis of the maximum value of the integrated target toner amount SAT at each main scanning position.

As described above, heat of the heating roller 310 is lost due to the sheet. Consequently, even with the same toner application amount of the local region, the heat amount may become excessive at the leading end in the sheet conveyance direction when the fixing temperature same as the rear end is set. Conversely, even with the same toner application amount of the local region, the heat amount may become insufficient at the rear end in the sheet conveyance direction when the fixing temperature same as the leading end is set. In the present invention, in view of the fact that heat of the heating roller 310 is lost due to the sheet, the weight of the local region is increased toward the rear side in the conveyance direction of the sheet. With this configuration, the fixing temperature of the fixing unit 221 can be appropriately controlled, and favorable fixing with an appropriate heat amount can be achieved.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-142562, filed on Jul. 30, 2018, which is hereby incorporated by reference herein in its entirety.

What is claimed is:

1. An image forming apparatus comprising:

an image forming unit configured to form a toner image on a sheet based on image data;

a fixing unit configured to fix the toner image to the sheet;

a determination unit configured to determine, based on the image data, a toner application amount corresponding to each of a plurality of regions in the sheet on which the toner image is to be formed; and a control unit configured to weight the toner application amount of each of the plurality of regions with a region weight imparted to each of the plurality of regions, and to control a temperature of the fixing unit based on the toner application amount of each of the plurality of regions that is weighted, wherein the region weight is determined in accordance with a position of the region in the sheet in a conveyance direction of the sheet, and a region weight at a leading end in the conveyance direction is smaller than a region weight at a rear end in the conveyance direction.

2. The image forming apparatus according to claim 1, wherein the fixing unit includes a heating roller configured to heat the sheet; and the region weight is determined based on a circumferential length of the heating roller.

3. The image forming apparatus according to claim 2, wherein a length of each of the plurality of regions in the conveyance direction of the sheet is obtained by dividing the circumferential length of the heating roller by an integer.

4. The image forming apparatus according to claim 2, wherein the control unit groups the plurality of regions into a plurality of groups, integrates the toner application amounts of regions included in each group of the plurality of groups that are weighted to determine a first integrated toner amount of each group, and controls a temperature of the fixing unit based on the first integrated toner amount of each group; and regions included in a same group make contact with a same region of the heating roller.

5. The image forming apparatus according to claim 4, wherein the control unit integrates the first integrated toner amounts of a group, of the plurality of groups, that is located at a same position in a main scanning direction orthogonal to the conveyance direction of the sheet to determine a second integrated toner amount for each position in the main scanning direction; and the control unit controls the temperature of the fixing unit based on the second integrated toner amount of each position in the main scanning direction.

6. The image forming apparatus according to claim 5, wherein the control unit controls the temperature of the fixing unit based on a maximum value of the second integrated toner amount of each position in the main scanning direction.

7. The image forming apparatus according to claim 1, wherein the fixing unit includes a heating roller configured to heat the sheet; and the image forming apparatus further comprises an imparting unit configured to impart the region weight to each of the plurality of regions based on a circumferential length of the heating roller.

8. The image forming apparatus according to claim 1, wherein the fixing unit includes a heating roller configured to heat the sheet; and the region weight that is imparted to a region, of the plurality of regions, that makes contact with the heating roller in an n-th turn of the heating roller is smaller than the region weight that is imparted to a region, of the plurality of regions, that makes contact with the heating roller in an (n+1)-th turn of the heating roller, n being an integer equal to or greater than 1.

9. The image forming apparatus according to claim 1, wherein the determination unit is further configured to determine the toner application amount of each of the plurality of regions based on the image data on which halftone processing has been performed.

10. The image forming apparatus according to claim 1, wherein the determination unit is further configured to determine the toner application amount of each of the plurality of regions based on the image data prior to a tone correction processing.

* * * * *